US008394211B2

(12) United States Patent
Nakata et al.

(10) Patent No.: US 8,394,211 B2
(45) Date of Patent: Mar. 12, 2013

(54) MAGNESIUM ALLOY MATERIAL AND METHOD FOR MANUFACTURING SAME

(75) Inventors: Mamoru Nakata, Inabe (JP); Yuuichi Yamada, Yokohama (JP); Koji Itakura, Yokohama (JP); Takahiro Mibe, Yokohama (JP); Yoshio Okada, Yokohama (JP); Yoshihito Kawamura, Kumamoto (JP); Michiaki Yamasaki, Kumamoto (JP)

(73) Assignees: Kobe Steel, Ltd., Kobe-shi (JP); Nissan Motor Co., Ltd., Yokohama-shi (JP); National University Corporation Kumamoto University, Kumamoto-shi (JP)

( * ) Notice: Subject to any disclaimer, the term of this patent is extended or adjusted under 35 U.S.C. 154(b) by 642 days.

(21) Appl. No.: 12/293,489

(22) PCT Filed: Mar. 20, 2007

(86) PCT No.: PCT/JP2007/055656

§ 371 (c)(1),
(2), (4) Date: Nov. 4, 2008

(87) PCT Pub. No.: WO2007/108467

PCT Pub. Date: Sep. 27, 2007

(65) Prior Publication Data

US 2009/0056837 A1 Mar. 5, 2009

(30) Foreign Application Priority Data

Mar. 20, 2006 (JP) ..... 2006-077762
Nov. 17, 2006 (JP) ..... 2006-312168

(51) Int. Cl.
*C21D 11/00* (2006.01)

(52) U.S. Cl. ..... 148/501; 148/405

(58) Field of Classification Search ..... 148/667, 148/420, 501, 405; 420/406
See application file for complete search history.

(56) References Cited

U.S. PATENT DOCUMENTS

| | | | | |
|---|---|---|---|---|
| 6,193,817 | B1 * | 2/2001 | King et al. | 148/420 |
| 2004/0045639 | A1 | 3/2004 | Kikawa et al. | |
| 2006/0228249 | A1 * | 10/2006 | Lyon et al. | 420/406 |
| 2007/0125464 | A1 | 6/2007 | Kawamura et al. | |
| 2008/0152532 | A1 | 6/2008 | Nakata et al. | |

FOREIGN PATENT DOCUMENTS

| | | |
|---|---|---|
| EP | 1 816 224 A1 | 8/2007 |
| JP | 6-41701 | 2/1994 |

(Continued)

OTHER PUBLICATIONS

U.S. Appl. No. 12/678,516, filed Mar. 17, 2010, Nakata, et al.

(Continued)

*Primary Examiner* — Weiping Zhu
(74) *Attorney, Agent, or Firm* — Oblon, Spivak, McClelland, Maier & Neustadt, L.L.P.

(57) ABSTRACT

The present invention provides a magnesium alloy material excellent in high mechanical characteristics without using special manufacturing facilities or processes and a method for manufacturing the magnesium alloy material. The magnesium alloy material is an Mg—Zn—RE alloy containing Zn as an essential component, at least one of Gd, Tb, and Tm as RE, and the rest including Mg and unavoidable impurities and contains a needle-like precipitate or a board-like precipitate (lengthy precipitate: X-phase=β-phase, β'-phase, and β1-phase).

18 Claims, 15 Drawing Sheets

FOREIGN PATENT DOCUMENTS

| | | | |
|---|---|---|---|
| JP | 6-49579 | | 2/1994 |
| JP | 6-200350 | | 7/1994 |
| JP | 2002-256370 | | 9/2002 |
| JP | 2003-129160 | | 5/2003 |
| JP | 2003-129161 | | 5/2003 |
| WO | WO 03/016581 | A1 | 2/2003 |
| WO | WO 2005/052203 | A1 | 6/2005 |
| WO | WO 2005/052204 | A1 | 6/2005 |

OTHER PUBLICATIONS

J. F. Nie, et al., "Enhanced age hardening response and creep resistance of Mg-Gd alloys containing Zn", Scripta Materialia, vol. 53, No. 9, XP-005026363, Nov. 1, 2005, pp. 1049-1053.

Yoshihito Kawamura, et al., "Structure and Mechanical Properties of Rapidly Solidified $Mg_{97}Zn_1RE_2$ Alloys", Materials Science Forum, vols. 419-422, No. II, XP-009082498, Jan. 1, 2003, pp. 751-756.

U.S. Appl. No. 12/517,134, filed Jun. 1, 2009, Nakata, et al.

Yoshiyuki Okubo, et al., "Microstructures and mechanical properties of Mg-Gd-Y-Zn-Zr alloys with different Gd and Y contents", 108$^{th}$ Spring Meeting, Abstract of Lecture, The Japan Institute of Light Metals, May 2005, pp. 41-46 (plus 3 cover pages).

Minami Sasaki, et al., "Influence of heat treatment on long period stacking ordered phase formation in Mg-Zn-Gd alloy", The Japan Institute of Metals Autumn Lecture Meeting (2005), Sep. 28-30, 2005, cover pages and p. 391 (with English translation).

Michiaki Yamasaki, et al., "Mechanical properties of warm-extruded Mg-Zn-Gd alloy with coherent 14H long periodic stacking ordered structure precipitate", Scripta Materialia, Aug. 15, 2005, vol. 53, No. 7, 1 cover and pp. 799-803.

Minchul Kim, et al., "Development of high strength Mg-Zn-Gd alloys by rapid solidification processing", The Japan Institute of Light Metals, Abstract of Lecture, 2005, Autumn (109$^{th}$) Conference, Oct. 20, 2005, pp. 9-10 (plus 2 cover pages).

Takaomi Itoi, et al., The Japan Institute of Metals, Abstract of Lecture Koen Gaiyo, 2003, Autumn (133th) Conference, Oct. 11-13, 2003, 2 cover pages and p. 185.

Office Action issued Jan. 17, 2012, in Japanese Patent Application No. 2006-312168 with English translation.

Office Action issued Aug. 17, 2011, in European Patent Application No. 07 739 099.5.

* cited by examiner

200°C × 10h

300°C × 60h (a) as being solution treated phase showing $Mg_3Gd$ (d) 450℃ showing 14H-LPO (b) 250℃ phase showing $Mg_3Gd$
+ fine X-phase in grain (e) 500℃ phase showing 14H-LPO
+ phase showing $Mg_3Zn_3Gd_2$ (c) 350℃ phase showing $Mg_3Gd$
+ phase showing 14H-LPO (a) as being solution treated phase showing $Mg_3Gd$ (b) 2h phase showing $Mg_3Gd$
+ phase showing 14H-LPO (c) 10h phase showing 14H-LPO (d) 60h phase showing 14H-LPO

MAGNESIUM ALLOY MATERIAL AND METHOD FOR MANUFACTURING SAME

TECHNICAL FIELD

The present invention relates to a magnesium alloy material and a method for manufacturing the same and particularly to a magnesium alloy material having high mechanical strength and a method for manufacturing the same.

BACKGROUND ART

In general, magnesium alloy materials have the lowest density among alloys in practical use, lightweight and high strength and accordingly have been promoted for applications to casings of electric products, wheels of automobiles, underbody parts, peripheral parts for engines, and the like.

In particular, with respect to parts for uses relevant to automobiles, since high mechanical characteristics are required, as magnesium alloy materials containing an element such as Gd, Zn and the like, materials with specified configurations have been manufactured by a single-side rolling method and a rapid solidification method (e.g. Patent Document 1, Patent Document 2, and Non-Patent Document 1).

However, in specified manufacturing methods, although providing the above-mentioned magnesium alloy materials with high mechanical characteristics, there are problems that special facilities are required, the productivity is low, and further applicable parts are limited.

Therefore, conventionally, there have been proposed methods for manufacturing magnesium alloy materials in which even plastic processing (extrusion) is conducted from common melt casting with high productivity without using special facilities or processes described in the above-mentioned Patent Documents, mechanical characteristics useful for practical applications can be obtained (e.g. Patent Document 3 and Patent Document 4). The magnesium alloy materials disclosed in Patent Documents 3 and 4 are known to have high mechanical characteristics.

Patent Document 1: Japanese Patent Application Laid-Open (JP-A) No. 06-041701

Patent Document 2: JP-A No. 2002-256370

Patent Document 3: International Publication No. 2005/052204 Pamphlet

Patent Document 4: International Publication No. 2005/052203 Pamphlet

Non-Patent Document 1: Lecture Summary, the 108th Conference of Japan Institute of Light Metals, P 42-45 (2005)

DISCLOSURE OF THE INVENTION

Problems to be Solved by the Invention

However, there is room for the following improvements for conventional magnesium alloy materials.

That is, it has been required for the conventional magnesium alloy materials to further improve the strength in order to promote their application for automobiles for the purpose of lightweight.

In view of the circumstances of the above-described problems, the present invention has been completed and objects of the invention is to provide a magnesium alloy material excellent in high mechanical characteristics without using special manufacturing facilities or processes and a method for manufacturing the magnesium alloy material.

Means for Solving the Problems

To solve the above-mentioned problems, the invention provides a magnesium alloy material having the following configuration. That is, the magnesium alloy material is an Mg—Zn—RE alloy containing Zn as an essential component, at least one of Gd, Tb, and Tm as RE, and the rest including Mg and unavoidable impurities and contains a needle-like precipitate or a board-like precipitate.

Due to the above-mentioned configuration, the magnesium alloy is remarkably improved in 0.2% proof strength by precipitation strengthening of the material by an X-phase, which is a needle-like precipitate or a board-like precipitate, as compared with those having a long-period ordered (LPO) structure. This magnesium alloy forms, for example, a crystallized substance of $Mg_3Gd$ ($Mg_3Zn_3Tb_7$ or $Mg_{24}Tm_5$) with one or more of Gd, Tb, and Tm as RE and is provided with improved 0.2% proof strength in combination with a needle-like precipitate or a board-like precipitate, which is an X-phase (at least one of β-phase, β'-phase, and β1-phase). The needle-like precipitate or board-like precipitate, which is an X-phase, is preferably 7 μm or less.

Further, in the above-mentioned magnesium alloy material, the needle-like precipitate or board-like precipitate is made to be $Mg_5Gd$ and/or $Mg_7Gd$.

As described above, the needle-like precipitate or board-like precipitate is $Mg_5Gd$ and/or $Mg_7Gd$, so that the strength of the alloy can be improved. In the case where the ratio of $Mg_7Gd$ is higher, a β'-phase is formed. In the case where the ratio $Mg_5Gd$ is higher and the state of the $Mg_5Gd$ is a hexagonal close-packed structure, a β1-phase is formed, and further in the case where the state of $Mg_5Gd$ includes precipitates with a body-centered cubic lattice, a β-phase is formed.

Further, in the above-mentioned magnesium alloy material, the component ranges are preferably 0.5 to 5% by atom for Zn and 1 to 5% by atom for RE.

Due to this configuration, the magnesium alloy material containing components, Zn and RE (Gd, Tb, Tm), in the prescribed ranges is made easy to form a needle-like precipitate or a board-like precipitate, which is an X-phase, for improving the strength.

Further, to solve the above-mentioned problems, with respect to a method for manufacturing a magnesium alloy material, the method for manufacturing a magnesium alloy material involves a casting step of forming a cast material by casting an Mg—Zn—RE alloy containing Zn as an essential component, at least one of Gd, Tb, and Tm as RE, and the rest including Mg and unavoidable impurities, a solution step of solubilizing the above-mentioned cast material, and a heat treatment step of carrying out heat treatment for the solubilized cast material in prescribed conditions and the above-mentioned heat treatment step is carried out in conditions satisfying $-18[\ln(x)]+240<y<-12[\ln(x)]+375$ and $2<x<300$, wherein y denotes the heat treatment temperature (° C.) and x denotes the heat treatment time (hr).

In the method for manufacturing the magnesium alloy material by the above-mentioned procedure, the precipitates of Mg and RE become in a solubilized state by the solution treatment and further a needle-like precipitate or a board-like precipitate ($Mg_5Gd$ and/or $Mg_7Gd$), which is an X-phase (at least one of β-phase, β'-phase, and β1-phase), is formed in the magnesium alloy material by the heat treatment step in the prescribed heat treatment conditions and accordingly precipitation strengthening is caused and 0.2% proof strength can be improved.

Further, with respect to a method for manufacturing the magnesium alloy material, the method involves a casting step of forming a cast material by casting an Mg—Zn—RE alloy containing Zn as an essential component, at least one of Gd, Tb, and Tm as RE, and the rest including Mg and unavoidable impurities, a solution step of solubilizing the above-mentioned cast material, a heat treatment step of carrying out heat treatment for the solubilized cast material in prescribed conditions, and a plasticity processing step of carrying out plastic processing of the above-mentioned heat-treated cast material and the above-mentioned heat treatment step is carried out in conditions satisfying $-18[\ln(x)]+240<y<-12[\ln(x)]+375$ and $2<x<300$, wherein y denotes the heat treatment temperature (° C.) and x denotes the heat treatment time (hr). In the above-mentioned method for manufacturing the magnesium alloy material, the plasticity processing step is an extrusion process or a forging process.

In the method for manufacturing the magnesium alloy material by the above-mentioned procedure, the precipitates of Mg and RE become in a solubilized state by the solution treatment and further a needle-like precipitate or a board-like precipitate ($Mg_5Gd$ and/or $Mg_7Gd$), which is an X-phase (at least one of β-phase, β'-phase, and β1-phase), is formed by the heat treatment in the prescribed conditions and accordingly the degree of elongation and 0.2% proof strength can be improved.

Further, with respect to a method for manufacturing the magnesium alloy material, the method involves a casting step of forming a cast material by casting an Mg—Zn—RE alloy containing Zn as an essential component, at least one of Gd, Tb, and Tm as RE, and the rest including Mg and unavoidable impurities, a solution step of solubilizing the above-mentioned cast material, and a heat treatment step of carrying out heat treatment for the solubilized cast material in prescribed conditions and the above-mentioned heat treatment step is carried out in conditions satisfying $330-20\times\ln(t)<T<325$ and $t\geqq5$, wherein T denotes the heat treatment temperature (° C.) and t denotes the heat treatment time (hr).

In the method for manufacturing the magnesium alloy material by the above-mentioned procedure, the precipitates of Mg and RE become in a solubilized state by the solution treatment and further a needle-like precipitate or a board-like precipitate ($Mg_5Gd$ and/or $Mg_7Gd$), which is an X-phase (at least one of β-phase, β'-phase, and β1-phase), is formed in the magnesium alloy material by the heat treatment step in the prescribed more preferable heat treatment conditions and accordingly precipitation strengthening is caused and 0.2% proof strength can be improved.

Further, with respect to a method for manufacturing the magnesium alloy material, the method involves a casting step of forming a cast material by casting an Mg—Zn—RE alloy containing Zn as an essential component, at least one of Gd, Tb, and Tm as RE, and the rest including Mg and unavoidable impurities, a solution step of solubilizing the above-mentioned cast material, a heat treatment step of carrying out heat treatment for the solubilized cast material in prescribed conditions, and a plasticity processing step of carrying out plastic processing of the above-mentioned heat-treated cast material, and the above-mentioned heat treatment step is carried out in conditions satisfying $330-20\times\ln(t)<T<325$ and $t\geqq5$, wherein T denotes the heat treatment temperature (° C.) and t denotes the heat treatment time (hr). In the above-mentioned method for manufacturing the magnesium alloy material, the plasticity processing step is an extrusion process or a forging process.

In the method for manufacturing the magnesium alloy material by the above-mentioned procedure, the precipitates of Mg and RE become in a solubilized state by the solution treatment and further a needle-like precipitate or a board-like precipitate ($Mg_5Gd$ and/or $Mg_7Gd$), which is an X-phase (at least one of β-phase, β'-phase, and β1-phase), is formed by the heat treatment step in the prescribed more preferable heat treatment conditions and accordingly the degree of elongation and 0.2% proof strength can be sufficiently improved.

Effect of the Invention

A magnesium alloy material and its manufacturing method according to the invention have the following excellent effects.

Since the magnesium alloy material contains a needle-like precipitate or a board-like precipitate ($Mg_5Gd$ and/or $Mg_7Gd$) which is an X-phase (at least one of β-phase, β'-phase, and β1-phase), at a prescribed degree of elongation, 0.2% proof strength can be remarkably improved as compared with those of material having a long period ordered structure. Further, when an extrusion (plasticity) process is carried out, since the long period ordered structure exists in the crystal structure, such high mechanical characteristics that common treatment cannot achieve can be obtained. Therefore, the magnesium alloy material is made usable for, for example, automotive parts, particularly parts such as pistons to which mechanical characteristics durable under severe conditions are required.

In the method for manufacturing the magnesium alloy material, since the heat treatment is carried out in prescribed conditions after the solution treatment, the X-phase (at least one of β-phase, β'-phase, and β1-phase), which is a needle-like precipitate or a board-like precipitate ($Mg_5Gd$ and/or $Mg_7Gd$), is formed in the magnesium alloy material and thus it is made possible to efficiently manufacture the magnesium alloy material provided with rather much improved 0.2% proof strength at a prescribed degree of elongation as compared with conventional materials by common manufacturing facilities or processes.

Further, in the method for manufacturing the magnesium alloy material, the heat treatment is carried out in conditions of a heat treatment temperature and a heat treatment time satisfying $-18[\ln(x)]+240<y<-12[\ln(x)]+375$ and $2<x<300$, wherein y denotes the heat treatment temperature (° C.) and x denotes the heat treatment time (hr), so that it is made possible to manufacture the magnesium alloy material provided with rather much improved 0.2% proof strength at a prescribed degree of elongation in a widened range (as compared with those having a long period ordered structure).

Furthermore, the heat treatment is preferably carried out in conditions of a heat treatment temperature and a heat treatment time satisfying $30-20\times\ln(t)<T<325$ and $t\geqq5$, wherein T denotes the heat treatment temperature (° C.) and t denotes the heat treatment time (hr), so that it is made possible to manufacture the magnesium alloy material provided with remarkably improved 0.2% proof strength at a prescribed degree of elongation (as compared with those having a long period ordered structure).

BRIEF DESCRIPTION OF THE DRAWINGS

FIG. 2(*a*) is a SEM photograph showing a state in which a crystallized substance of $Mg_3Gd$ and a needle-like precipitate or a board-like precipitate appear in the magnesium alloy material. FIG. 2(*b*) is a TEM photograph showing a state in which a needle-like precipitate or a board-like precipitate appears in the magnesium alloy material. FIG. 2(*c*) is a TEM photograph showing a state in which a needle-like precipitate or a board-like precipitate, a crystallized substance of $Mg_3Gd$ and a long period ordered structure appear in the magnesium alloy material.

EXPLANATION OF THE SYMBOLS

1: magnesium alloy material
2: lengthy precipitate (needle-like precipitate or board-like precipitate: X phase=one of β'-phase, β1-phase and β-phase)
3: long period ordered (LPO) structure

BEST MODE FOR CARRYING OUT THE INVENTION

Figure 1:
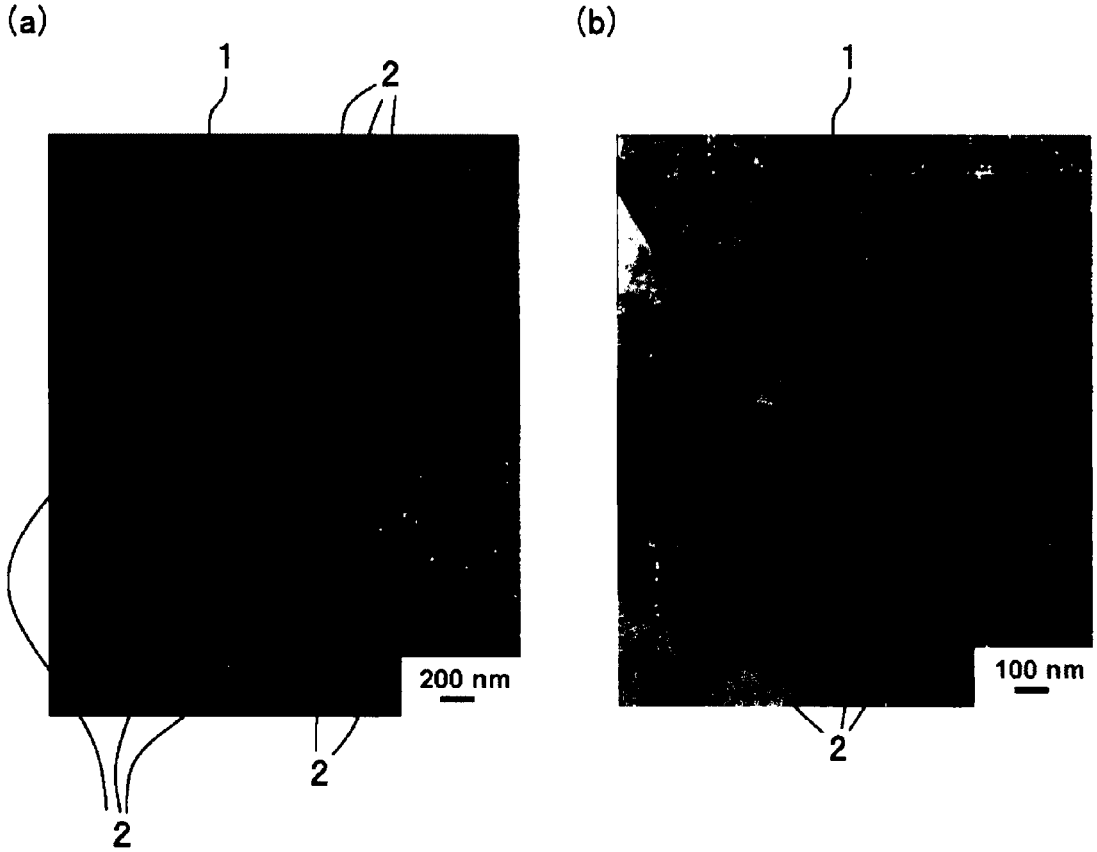
FIGS. 1(*a*) and 1(*b*) are TEM photographs showing a needle-like precipitate or a board-like precipitate existing in the metal structure of a magnesium alloy according to the invention.
Figure 2:
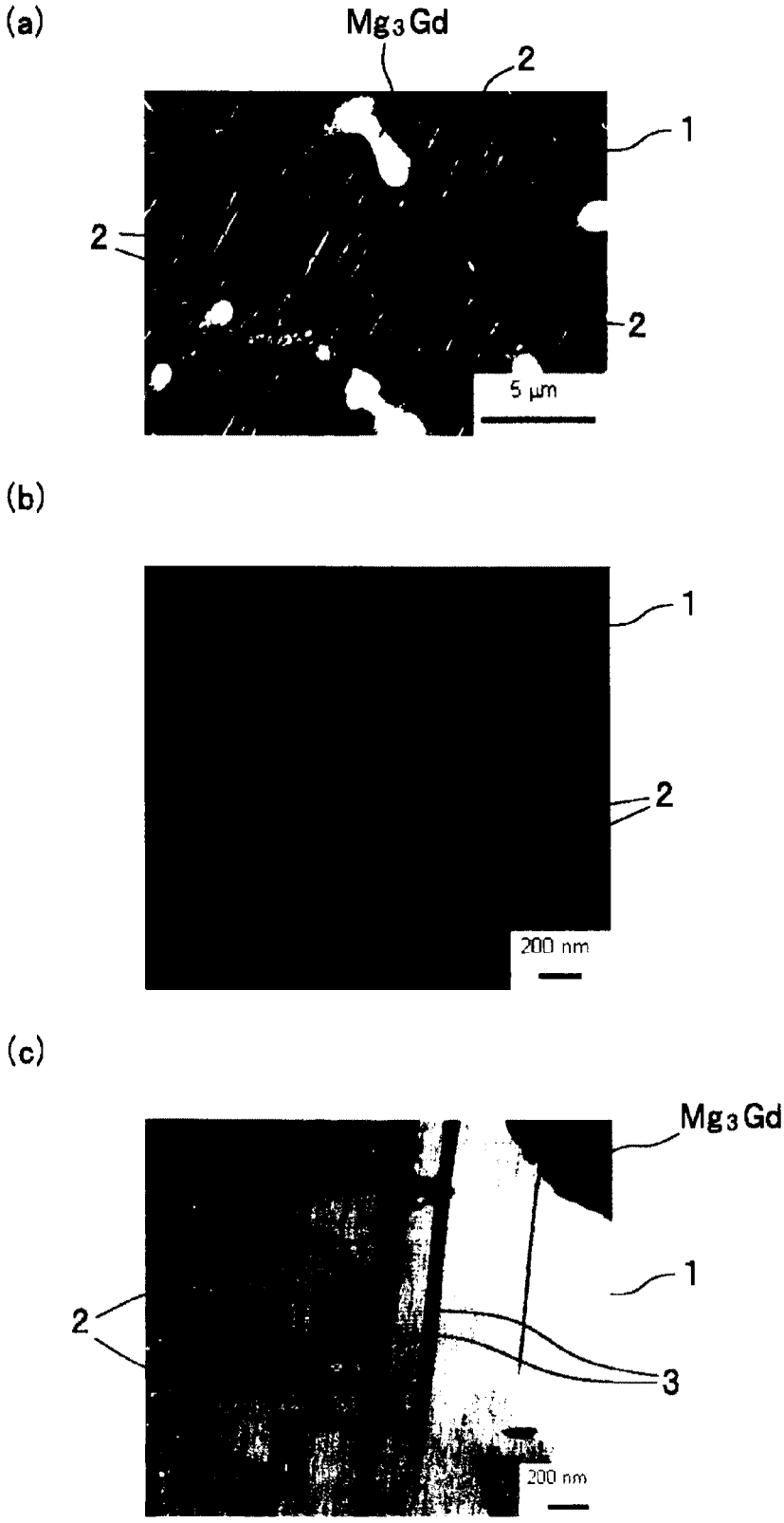
FIGS. 2(*a*), 2(*b*), and 2(*c*) are TEM or SEM photographs showing the metal structure of the magnesium alloy according to the invention.

Hereinafter, the best modes of embodiments of the invention will be described with reference to drawings. FIGS. 1(*a*) and 1(*b*) are TEM photographs showing a needle-like precipitate or a board-like precipitate existing in a metal structure of a magnesium alloy material. FIG. 2(*a*) is a SEM photograph showing the state in which a crystallized substance of $Mg_3Gd$ and a needle-like precipitate or a board-like precipitate appear in the magnesium alloy material. FIG. 2(*b*) is a TEM photograph showing the state in which a needle-like precipitate or a board-like precipitate appears in the magnesium alloy material. FIG. 2(*c*) is a TEM photograph showing the state in which a needle-like precipitate or a board-like precipitate, a crystallized substance of $Mg_3Gd$ and a long period ordered structure appear in the magnesium alloy material.

A magnesium alloy material 1 is an Mg—Zn—RE alloy containing Zn as an essential component, at least one of Gd, Tb, and Tm as RE (rare earth metals), and the rest including Mg and unavoidable impurities, and herein an example containing Gd will be described. As shown in FIG. 1 and FIG. 2(*b*), the magnesium alloy material 1 forms a fine needle-like precipitate or a fine board-like precipitate (hereinafter, sometime referred to as a lengthy precipitate 2 for convenience).

As shown in FIG. 2(*a*), in the magnesium alloy material in the case where RE is Gd in the Mg—Zn—RE alloy, a numberless of white, fine needle-like or fine board-like lengthy precipitates 2 (needle-like precipitates or board-like precipitates) and $Mg_3Gd$ precipitates in the white and dropped dot-like parts (larger than the needle-like precipitates or board-like precipitates) are precipitated in the magnesium alloy material 1 while being mixed. Further, as shown in FIG. 2(*c*), herein, it is understood that the magnesium alloy material 1 has a configuration composed of the lengthy precipitates 2, crystallized substances of $Mg_3Gd$, and a long period ordered structure 3. The crystallized substances of $Mg_3Gd$ of the magnesium alloy material are made to be a solid solution by solution treatment which will be described hereinafter and it is presumed that if the addition amount thereof is too high, they appear as a supersaturated solid solution. Therefore, it can be presumed that the magnesium alloy material comes into existence as a configuration having only the lengthy precipitates 2 or a configuration having a state in which the lengthy precipitates 2 and the long period ordered structure 3 exist.

[(needle-like precipitate or board-like precipitate)=(at least one of β-phase, β'-phase, and β1-phase)=($Mg_5Gd$ and/or $Mg_7Gd$)]

In the magnesium alloy material, the needle-like precipitates or board-like precipitates (lengthy precipitates 2) are an X-phase (X-phase=at least one of β-phase, β'-phase, and β1-phase) and precipitates formed in a prescribed temperature condition. Appearance of this X-phase improves the mechanical strength (0.2% proof strength). This X-phase does not contribute to improvement of the strength if the lengthy precipitates 2 are thin and fine needle-like or board-like precipitates and too small. On the other hand, if they are too large, the precipitates become starting points of breakage to lead to decrease of the elongation. Therefore, the lengthy precipitate 2 preferably has a size (length) in a range of 0.1 to 20 μm, more preferably in a range of 0.2 to 10 μm, and even more preferably in a range of 0.3 to 7 μm. The lengthy precipitates 2 are those having thin and long shape with a vertical-to-transverse ratio of 2:1.

Figure 3:
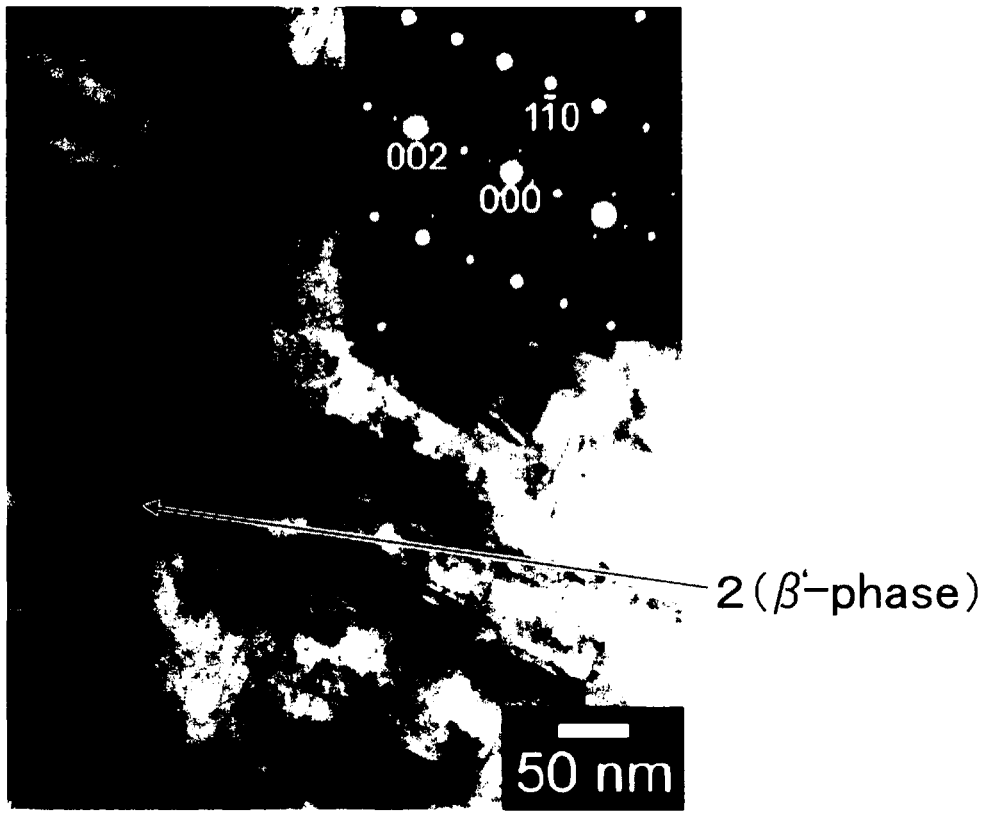
FIG. 3 is a TEM photograph showing the metal structure of the magnesium alloy according to the invention and a state in which a β'-phase (lengthy precipitate) appears.
Figure 4:
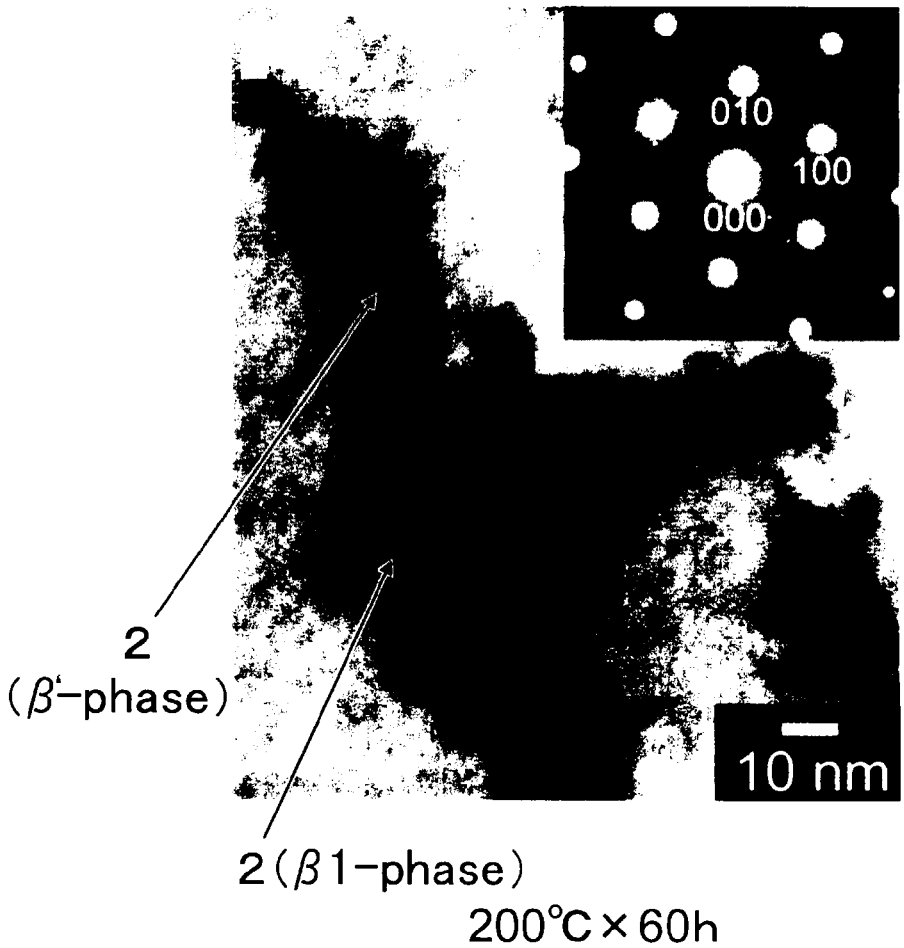
FIG. 4 is a TEM photograph showing the metal structure of the magnesium alloy according to the invention and a state in which a β'-phase and a β1-phase (lengthy precipitate) appear.
Figure 5:
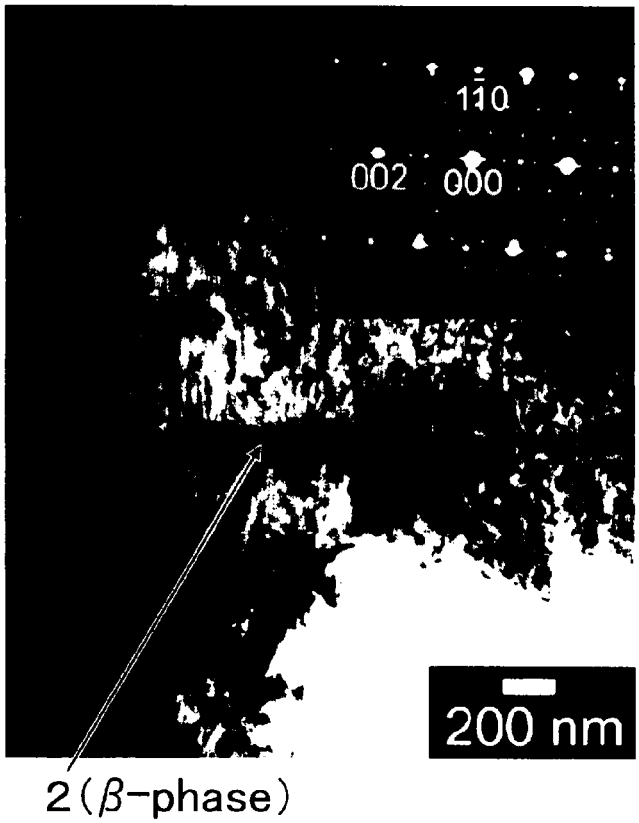
FIG. 5 is a TEM photograph showing the metal structure of the magnesium alloy according to the invention and a state in which a β-phase (lengthy precipitate) appears.

Further, as shown in FIG. 3 to FIG. 5, the lengthy precipitate 2 is found having a phase state changed from a β'-phase to a β1-phase and from a β1-phase to a β-phase in accordance the temperature condition and the heat time. Therefore, it is understood that the appearing lengthy precipitate 2 has as the phase state, at least one of a β'-phase, a β1-phase and a β-phase and the metal structure as the β'-phase, the β1-phase and the β-phase is either $Mg_5Gd$ or $Mg_7Gd$, or $Mg_5Gd$ in combination with $Mg_7Gd$.

The composition of the β'-phase is Mg Gd and the β1-phase and the β-phase are $Mg_5Gd$. Since the β1-phase and the β-phase have the same composition but mutually different structures, the β1-phase and the β-phase are referred differently as they are. That is, as the base for distinction, the β1-phase has the hexagonal close-packed structure of $Mg_5Gd$ and on the other hand, the β-phase has the body-centered cubic lattice as the $Mg_5Gd$ structure. In the magnesium alloy material 1, $Mg_5Gd$ and/or $Mg_7Gd$ improves the strength of the alloy in the state in which the elongation is maintained. The reason for the structure change in spite of the same $Mg_5Gd$ is because the β'-phase is changed to be the β1-phase by heat energy and depending on the heat treatment condition, both may possibly exist together in the middle of the change.

As shown in FIG. 3 and FIG. 4, the β'-phase, which is the lengthy precipitate 2, appears as a state in which $Mg_7Gd$ is orderly and linearly arranged in parallel. Further, as shown in FIG. 4, the β1-phase, which is the lengthy precipitate 2, is seen as a black and short needle-like or board-like precipitate reciprocally appearing in different directions in a zigzag state. Further, as shown in FIG. 5, the β-phase, which is the lengthy precipitate 2, appears in the center of the photograph in the form of thin and long needle-like or board-like precipitates. Additionally, in FIG. 3 to FIG. 5, a matrix appears in the surrounding of the lengthy precipitate 2 (least one of β-phase, β'-phase, and β1-phase).

(Long Period Ordered Structure and its Interval)

The long period ordered structure (Long Period Ordered Structure, abbreviated as LPO or LPOS) 3 is such along cycle structure that, for example, 14 regular lattices are arranged and again 14 regular lattices are arranged in an opposite phase to form several or several ten times longer unit structure than the original lattice. This phase appears in a slight temperature range between a regular phase and an irregular phase. In a drawing of electron beam diffraction, reflection of the regular phase is disrupted so that diffraction spots appear at positions corresponding to the ten-time cycles. The long period ordered structure 3 is known to appear in intermetallic compounds or the like.

Additionally, $Mg_3Gd$ ($Mg_3Zn_3Tb_2$ or $Mg_{24}Tm_5$) is crystallized in grain boundaries at the time of casing and solidifying and made to form a solid solution by the solution treatment to form the lengthy precipitate 2 or the long period ordered structure 3.

(Alloy Composition)

[Zn: 0.5 to 3% by atom (at. %)]

If the content of Zn is less than 0.5 at. %, no $Mg_3Gd$ can be formed to lower the strength. Further, if the content of Zn exceeds 3 at. %, strength improvement corresponding to the addition amount cannot be obtained and the elongation is lowered (the alloy becomes brittle). Accordingly, the content of Zn is defined in a range of 0.5 to 3 at. %.

[Re: (one or more of Gd, Tb, and Tm): 1 to 5 at. %]

Gd, Tb, and Tm cannot make the long period ordered structure 3 appear only by casting alone but can precipitate the long period ordered structure 3 or lengthy precipitates 2 by heat treatment in the prescribed condition after the casting. In the magnesium alloy material 1, the long period ordered structure 3 is precipitated in accordance with the heat treatment condition to improve the strength. In order to obtain higher strength, the lengthy precipitates 2 may be precipitated by solution treatment and heat treatment for $Mg_3Gd$ ($Mg_3Zn_3Tb_2$ or $Mg_{24}Tm_5$), or precipitation of the lengthy precipitates 2 and crystallization of $Mg_3Gd$ ($Mg_3Zn_3Tb_2$ or $Mg_{24}Tm_5$) may be simultaneously caused by solution treatment and heat treatment for $Mg_3Gd$ ($Mg_3Zn_3Tb_2$ or $Mg_{24}Tm_5$).

Therefore, the magnesium alloy material 1 is required to contain a prescribed amount of RE, at least one of Gd, Tb, and Tm. In the magnesium alloy material 1, if at least one of Gd, Tb, and Tm is in the total amount of less than 1 at. %, $Mg_3Gd$ ($Mg_3Zn_3Tb_2$ or $Mg_{24}Tm_5$) and the lengthy precipitates 2 cannot be precipitated, and if the total amount exceeds 5 at. %, strength improvement corresponding to the addition amount cannot be obtained and the elongation is lowered. Accordingly, the total content of RE, at least one of Gd, Tb, and Tm, in the magnesium alloy material 1 is defined in a range of 1 to 5 at. %.

Consequently, with respect to the alloy composition, the magnesium alloy material 1 has a composition on the basis of by atom, defined by a composition formula $Mg_{100-a-b}Zn_aRE_b$ (in the composition formula, $0.5 \leqq a \leqq 3$; $1 \leqq b \leqq 5$). In the invention, components other than the above-described components may be added within a range of unavoidable impurities in a range that the effect of the magnesium alloy of the invention is not affected and for example, Zr, which contributes to fineness, in an amount of 0.1 to 0.5 at. % may be added.

Next, a method for manufacturing the magnesium alloy material will be described.

Figure 6:
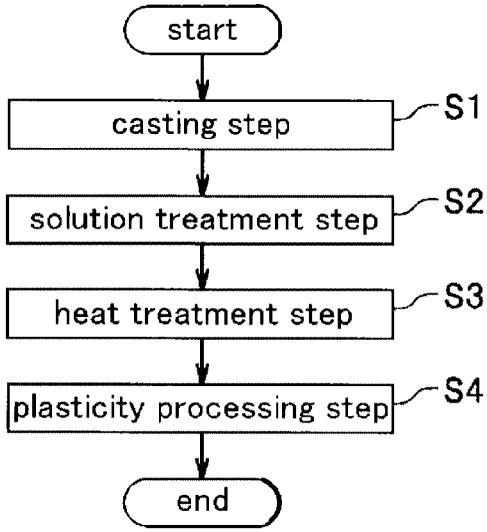
FIG. 6 is a flow chart showing a method for manufacturing a magnesium alloy according to the invention.
Figure 7:
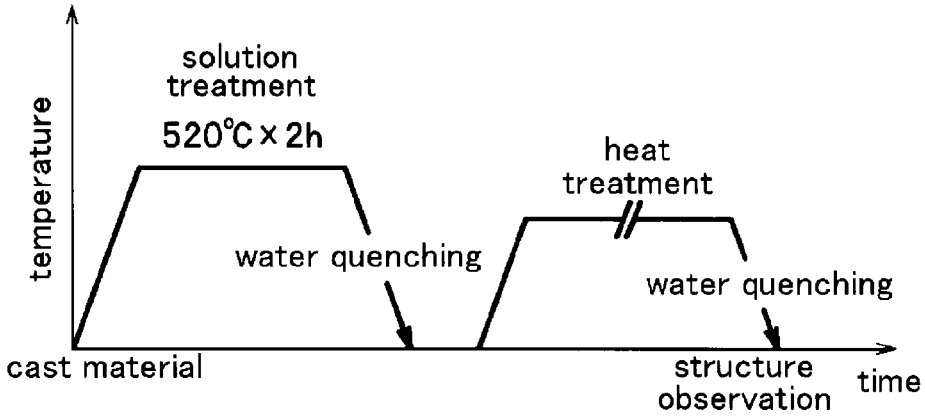
FIG. 7 is a graph schematically showing the relation of temperature and time of solution treatment and heat treatment of the magnesium alloy according to the invention.

FIG. 6 is a flow chart showing a method for manufacturing a magnesium alloy and FIG. 7 is a graph schematically showing the relation of temperature and time of solution treatment and heat treatment of a magnesium alloy.

A magnesium alloy material 1 is first cast in a casting step S1. Herein, the magnesium alloy material 1 has a composition formula $Mg_{100-a-b}Zn_aRE_b$ and contains Gd as RE. Next, the cast material is subjected to solution treatment (solid solution formation of RE) in a solution treatment S2. The temperature of the solution treatment at that time is, as an example, 520° C., and the solution treatment is carried out for 2 hours. In the cast material, a compound of Mg and Gd (Tb, Tm) formed by the casting is dissolved in a matrix and forms a solid solution by the solution treatment. The solution treatment is preferably carried out at 500° C. or higher for 2 hours or longer.

Further, a heat treatment step S3 for carrying out heat treatment of the solid solution-treated cast material in prescribed conditions is carried out. The lengthy precipitates (X phase=at least one of β'-phase, β1-phase and β-phase) 2 and the long period ordered structure 3 are precipitated by carrying out the heat treatment step S3 and crystallized substances of $Mg_3Gd$ ($Mg_3Zn_3Tb_2$ or $Mg_{24}Tm_5$) and $Mg_3Zn_3Gd_2$ may exist while being mixed.

The heat treatment step S3 are described here under two conditions. That is, two conditions; a condition in a preferred range (condition 1) and a condition in a more preferred range (condition 2).

Figure 8:
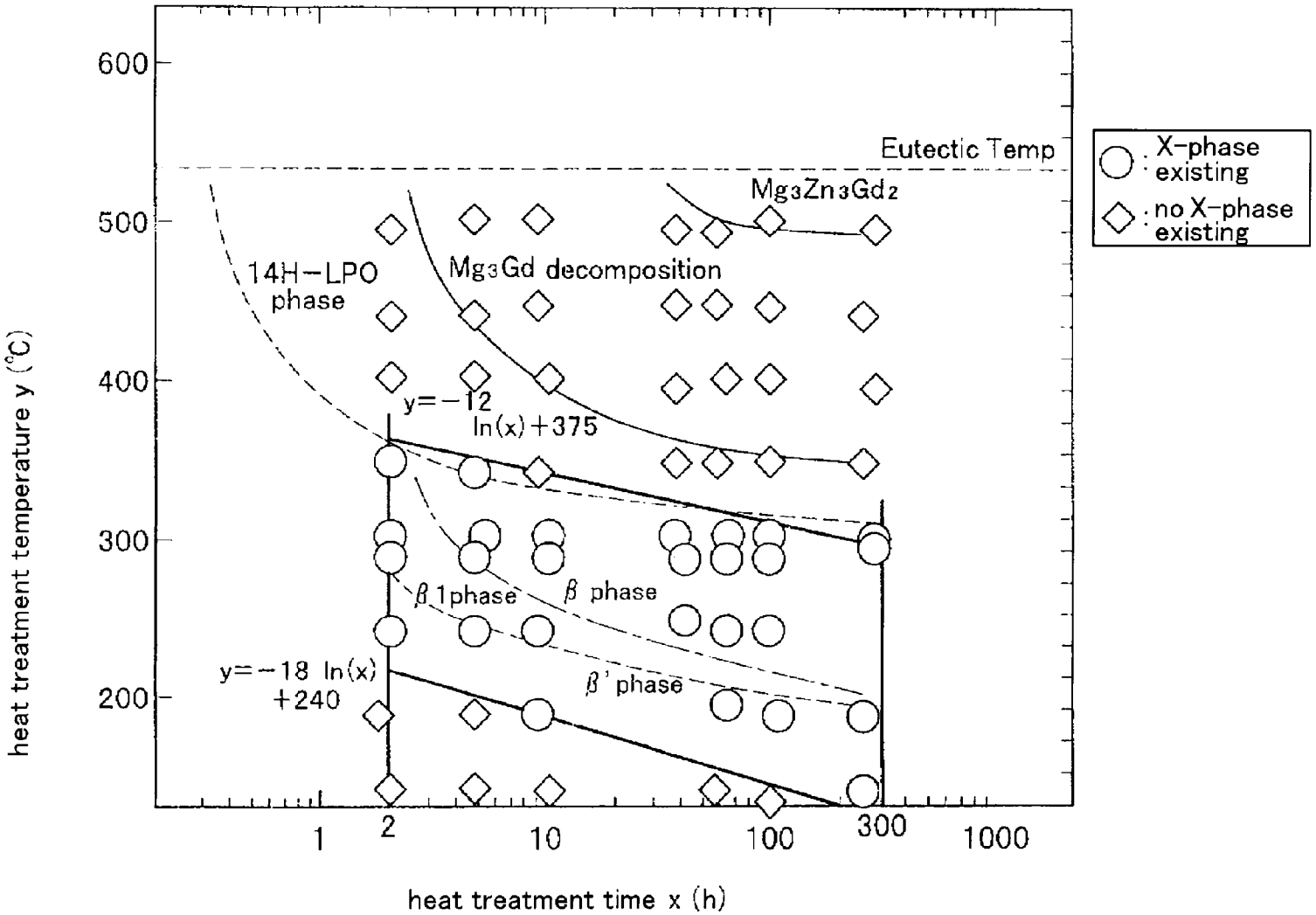
FIG. 8 is a graph showing a region of the precipitates formed in the metal structure at the heat treatment temperature and heat treatment time in a condition 1 according to the invention.

The condition 1 of the heat treatment step S3 is the condition satisfying $-18[\ln(x)]+240<y<-12[\ln(x)]+375$ and $2<x<300$, wherein y denotes the heat treatment temperature (° C.) and x denotes the heat treatment time (hr) (see FIG. 8: the region defined by the heat treatment temperature and the heat treatment time of the condition 1 is the area surrounded by the rectangle).

Figure 9:
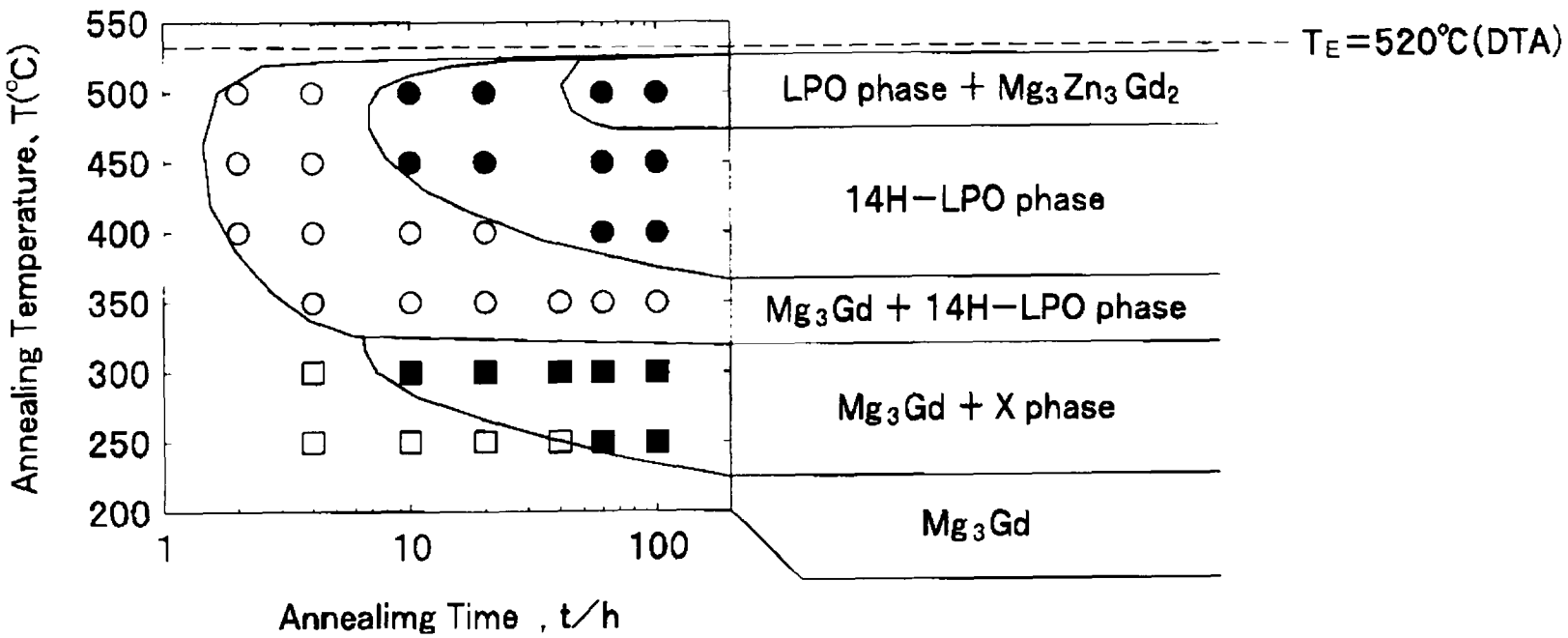
FIG. 9 is a graph showing a region of the precipitates formed in the metal structure at the heat treatment temperature and heat treatment time in a condition 2 according to the invention.

Further, the condition 2 of the heat treatment step S3 is the condition satisfying $330-20\times\ln(t)<T<325$ and $t \geqq 5$, wherein T denotes the heat treatment temperature (° C.) and t denotes the heat treatment time (hr) (see FIG. 9: the region defined by the heat treatment temperature and the heat treatment time of the condition 2 is the area surrounded by the lines of $Mg_3Gd$+X phase including the points shown with the black square).

In the heat treatment step S3, the range set in the condition 1 becomes a wider region and the range set in the condition 2 becomes a more or less narrower region. However, the condition 2 is more preferable range in the heat treatment step S3.

Figure 10:
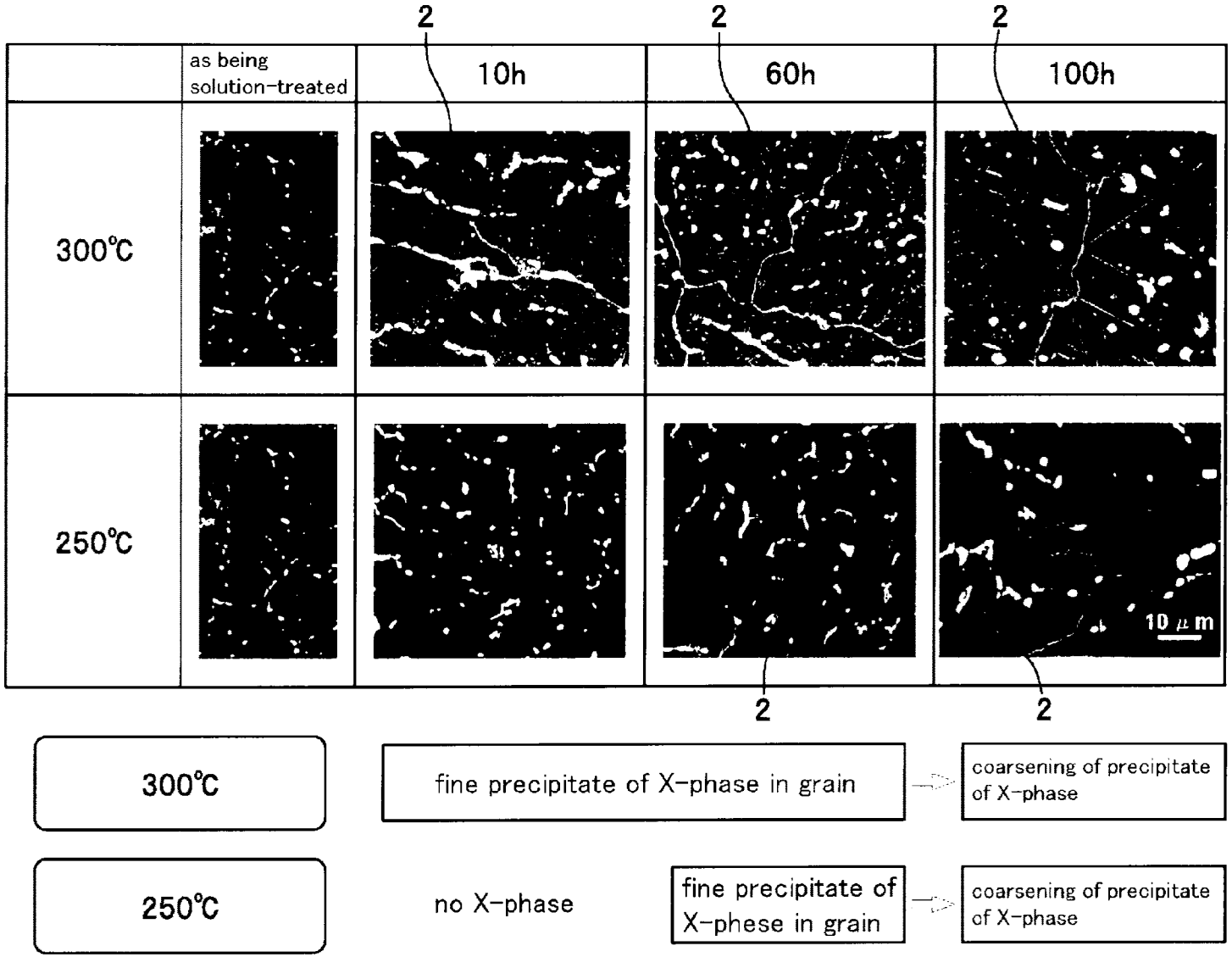
FIG. 10 shows TEM photographs showing states of the metal structures of magnesium alloys according to the invention at 300° C. and 250° C. and after 10 hours, 60 hours, and 100 hours.

When the heat treatment step S3 is carried out in the prescribed condition, as the magnesium alloy material 1, the structure of a phase region in which the lengthy precipitates (X-phase=at least one of β-phase, β'-phase, and β1-phase) 2 capable of improving particularly the strength are precipitated can be formed. FIG. 8 is a graph showing the region of the precipitates precipitated in the metal structure at the heat treatment temperature and heat treatment time in the condition 1. FIG. 9 is a graph showing the region of the precipitates precipitated in the metal structure at the heat treatment temperature and heat treatment time in the condition 2. FIG. 10 shows TEM photographs showing the state of the metal structure a magnesium alloy according to the invention at 300° C. and 250° C. and after 10 hours, 60 hours, and 100 hours. In FIG. 10, photographing is carried out to give the same scale for all.

As shown in FIG. 8, the range for precipitating the lengthy precipitates (X-phase: X-phase=at least one of β-phase, β'-phase, and β1-phase) 2 is the range of the prescribed heat treatment condition. As shown in FIG. 8, herein, the precipitates of $Mg_3Gd$ are precipitated together with the lengthy precipitates 2 ($Mg_5Gd$ and/or $Mg_7Gd$). It can be understood that the magnesium alloy material 1 is provided with improved 0.2% proof strength by precipitating the lengthy precipitates 2 ($Mg_5Gd$ and/or $Mg_7Gd$) (see FIG. 11: Cast-T6 material).

Further, as shown in FIG. 10, it is understood that at least one of a β'-phase, a β1-phase, and a β-phase, the lengthy precipitates 2, is precipitated in the case where the heat treatment temperature is 300° C. and the heat treatment time is set for 10 hours, 60 hours, and 100 hours, respectively and in the case where the heat treatment temperature is 250° C. and the heat treatment time is set for 60 hours and 100 hours, respectively. Further, if the heat treatment time is set to be 100 hours or longer, at least one of a β'-phase, a β1-phase, and a β-phase, which is an X-phase, is precipitated; however in consideration of practically applicable range, the heat treatment temperature range of the magnesium alloy material 1 is to be the above-mentioned $-18[\ln(x)]+240<y<-12[\ln(x)]+375$ and $2<x<300$, which is the condition 1 or the above-mentioned $330-20\times\ln(t)<T<325$ and $t\geqq 5$, which is the condition 2.

Figure 11:
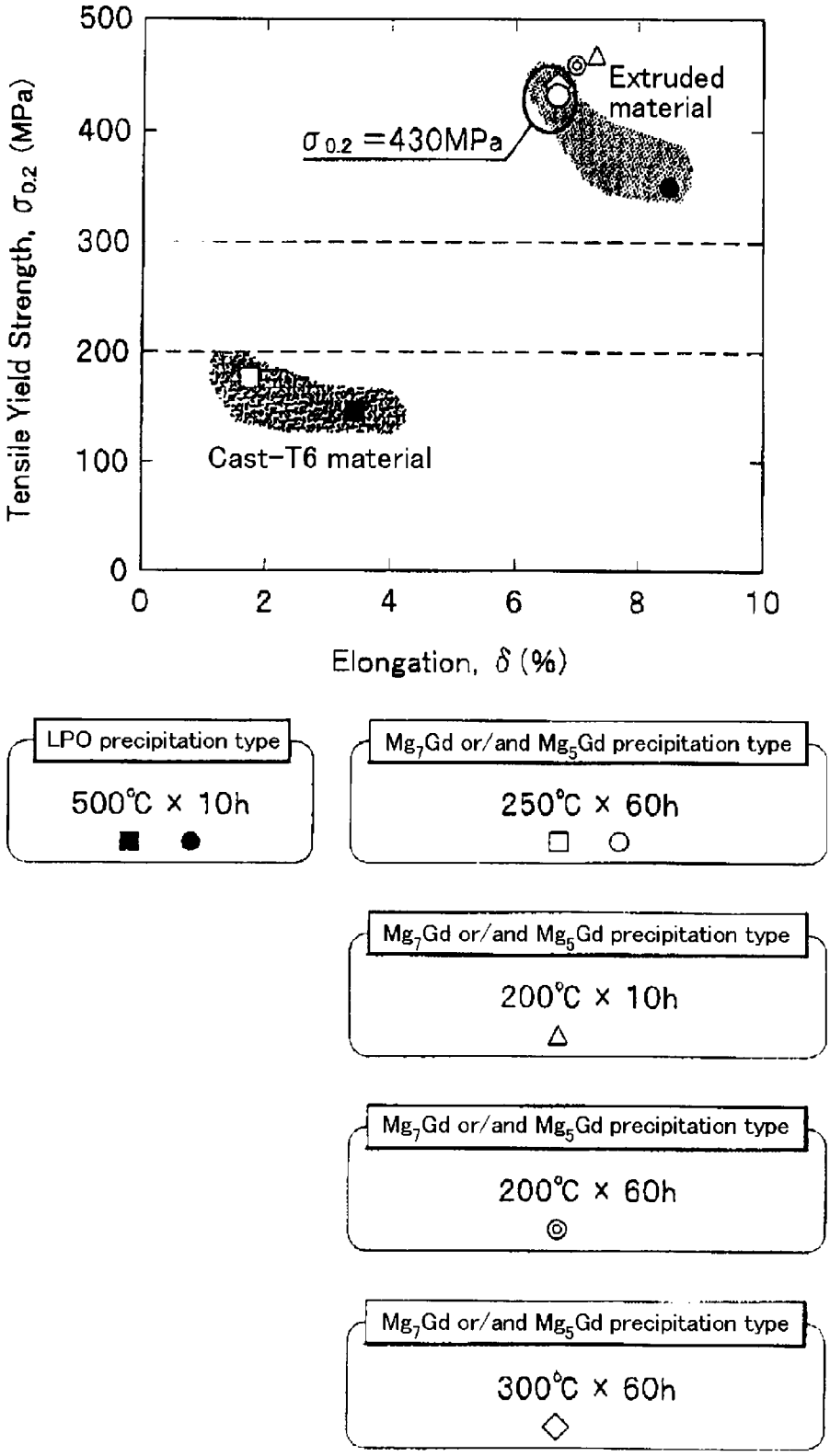
FIG. 11 is a graph showing the relation between the degree of elongation and 0.2% proof strength after extrusion processing carried out successively to heat treatment for the magnesium metal material of the invention and a conventional magnesium alloy material.

Next, the heat-treated cast product is subjected to a plasticity processing step S4 of carrying out plastic processing based on the necessity. The plasticity processing step S4 may be an extrusion process or forging process. The plasticity processed product is to be provided with remarkably improved 0.2% proof strength. FIG. 11 is a graph showing the relation between the degree of elongation and 0.2% proof strength after extrusion processing carried out successively to heat treatment for a magnesium metal material (extrusion material). As shown in FIG. 11, it is understood that the magnesium alloy material 1 subjected to the heat treatment step S3 and extrusion process, that is, the plasticity processing step S4, has a high 0.2% proof strength value.

Further, in the case where the 0.2% proof strength is improved in the heat treatment step S3 and the plasticity processing step S4, it is important that the magnesium alloy material 1 contains the lengthy precipitates (at least one of β'-phase, β1-phase, and β-phase) 2 and additionally, also in the case of the crystallized substances of $Mg_3Gd$ ($Mg_3Zn_3Tb_2$ or $Mg_{24}Tm_5$) or the precipitating long period ordered structure 3, if the lengthy precipitates (at least one of β'-phase, β1-phase, and β-phase) 2 are precipitated, the 0.2% proof strength can be improved.

Figure 12:
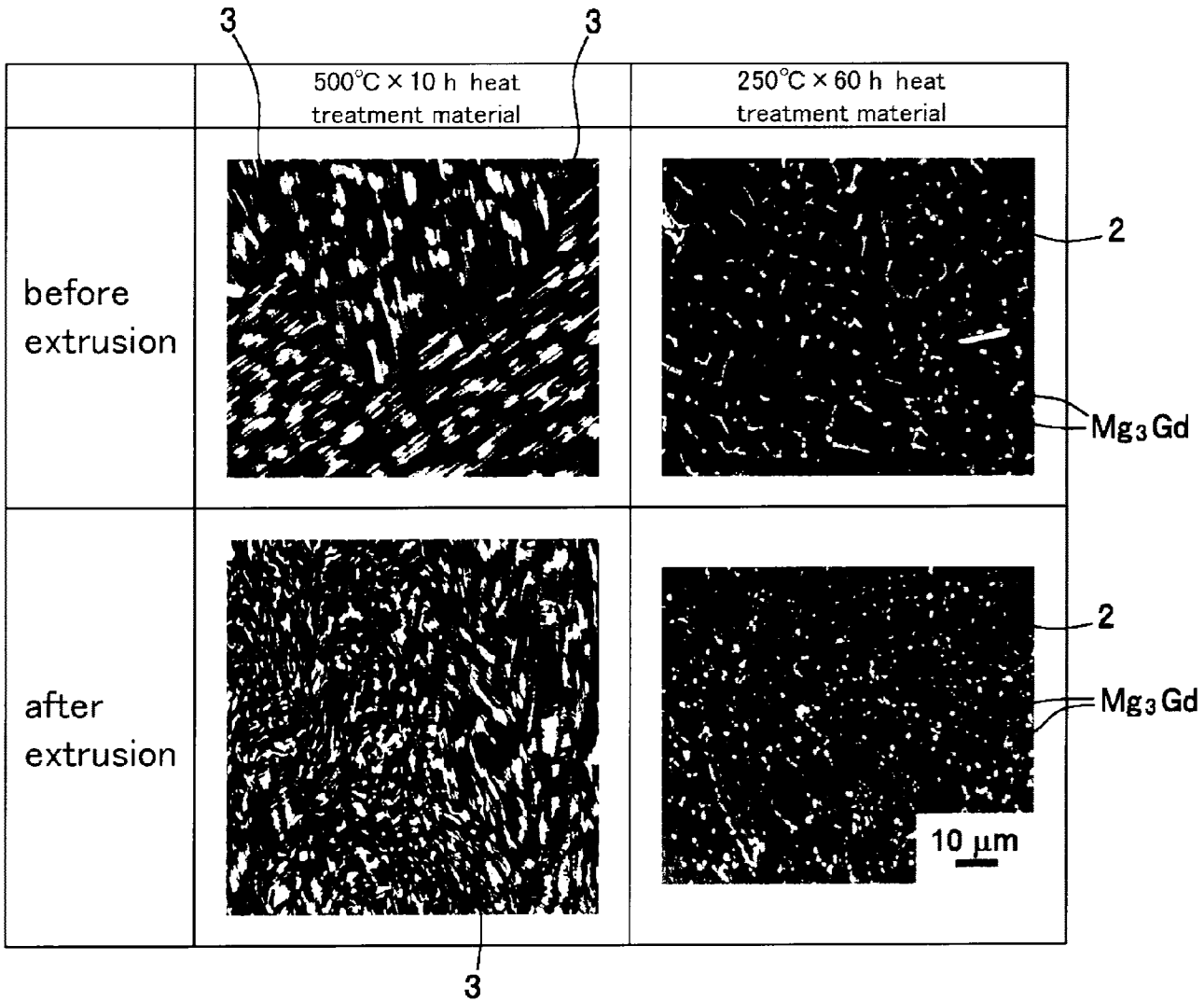
FIG. 12 is explanatory photographs for comparison of a TEM photograph of a metal structure of a magnesium alloy according to the invention in which lengthy precipitates appear after extrusion processing carried out successively to heat treatment at heat treatment temperature of 250° C. for 60 hours with a TEM photograph of a metal structure at heat treatment temperature of 500° C. for 10 hours.

Additionally, the metal structure states before and after the extrusion processing are shown in FIG. 12. FIG. 12 is explanatory photographs for comparison of a TEM photograph of a metal structure in which the lengthy precipitates of the magnesium alloy material appear after extrusion processing carried out successively to heat treatment at heat treatment temperature of 250° C. for 60 hours with a TEM photograph of a metal structure at heat treatment temperature of 500° C. for 10 hours. In FIG. 12, photographing is carried out to give same scale for all. As shown in FIG. 12, with respect to the material subjected to the heat treatment at 500° C. for 10 hours, although the long period ordered structure 3 is formed straightly before the extrusion processing, the X-phase (at least one of β'-phase, β1-phase and β-phase) is not precipitated at all. Similarly, the grain boundaries are not clear even after the extrusion processing and the long period ordered structure 3 is deformed and the X-phase (at least one of β'-phase, β1-phase and β-phase) is not precipitated at all. On the other hand, with respect to the material subjected to the heat treatment at 250° C. for 60 hours, a large number of precipitate of $Mg_3Gd$ and a numberless of (lengthy precipitates 2), a fine X-phase, that is, at least one of a β'-phase, a β1-phase and a β-phase, are precipitated before the extrusion processing. Similarly, even after the extrusion processing, a large number of precipitate of $Mg_3Gd$ and a numberless of (lengthy precipitates 2), a fine X-phase, that is, at least one of a β'-phase, a β1-phase and a β-phase, exist.

Further, as shown in FIG. 11, it is understood that the magnesium alloy material subjected to the heat treatment at 250° C. for 60 hours shows a high 0.2% proof strength value before and after extrusion processing. Accordingly, as shown in FIG. 8 and FIG. 9, the magnesium alloy material 1 in the region where the X phase, that is at least one of a β'-phase, a β1-phase and a β-phase, appears has a structure with more improved 0.2 proof strength than the magnesium alloy material in the region where the long period ordered structure 3 is formed.

Additionally, in the plasticity processing step S4 shown in FIG. 6, since the strength can be improved by carrying out the plasticity process (extrusion process, forging process) if the heat-treated cast product, the process can be added in accordance with the uses of the magnesium alloy material 1. Further, the magnesium alloy material 1 after the plasticity process is processed by cutting or the like into a prescribed shape to obtain a product. Furthermore, herein, although the method for manufacturing the magnesium alloy material 1 is described as a series of steps from the casting step S1 to the plasticity processing step S4, the manufacturing method may involve a series of steps from the casting step S1 to the heat treatment step S3 and the plasticity processing step S4 may be carried out in a product insertion site.

EXAMPLES

Figure 13:
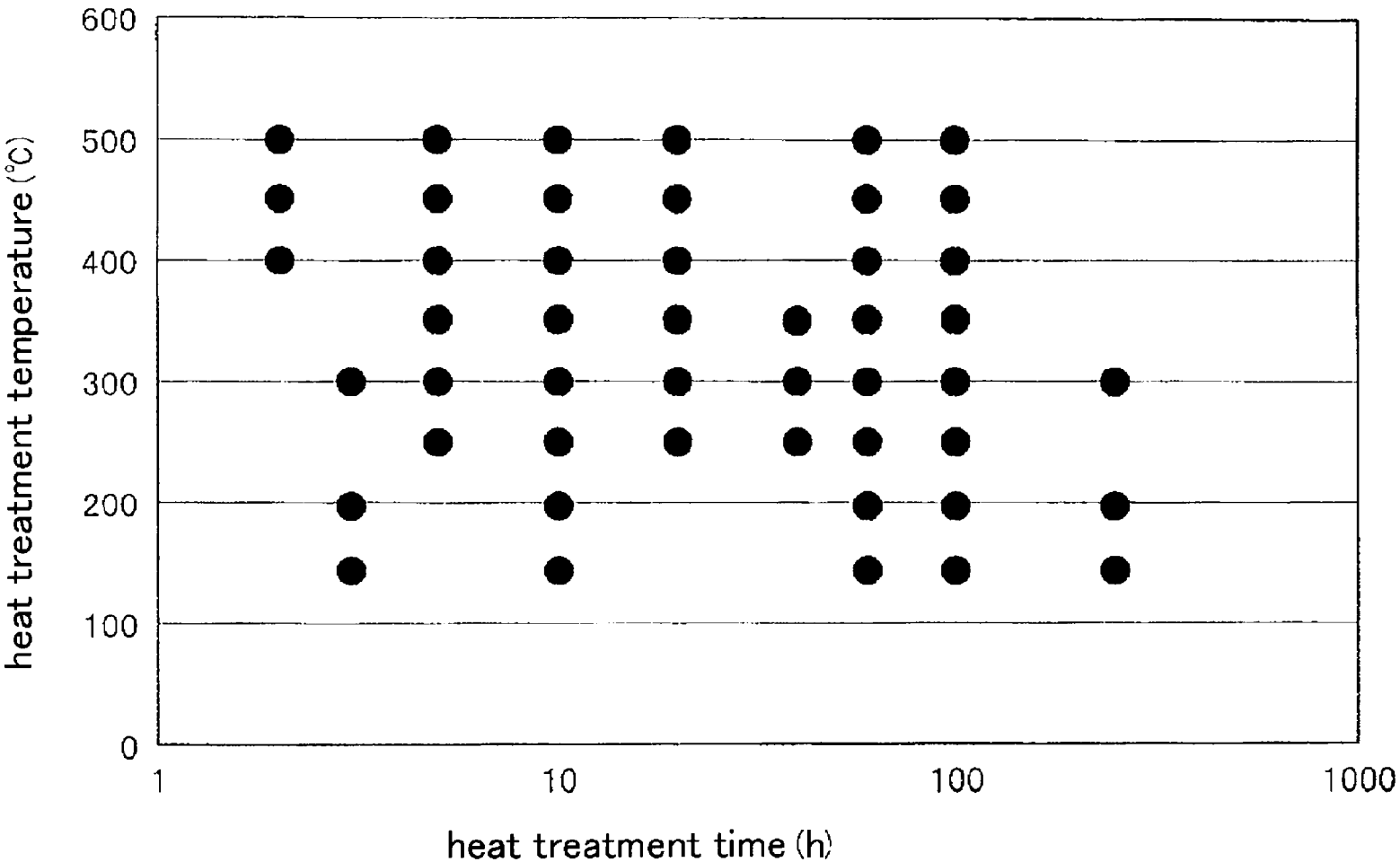
FIG. 13 is a graph showing the relation of heat treatment temperature and heat treatment time for the magnesium alloy material according to the invention.
Figure 14:
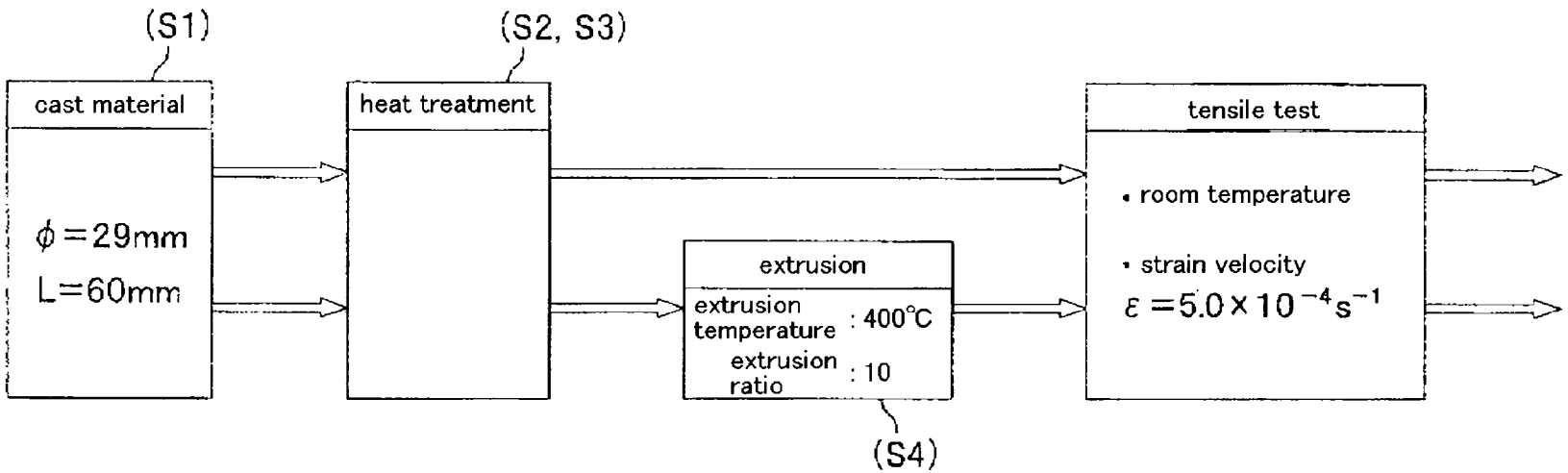
FIG. 14 is a block view showing the respective steps for evaluating the mechanical characteristics for explaining Examples according to the invention.
Figure 15:
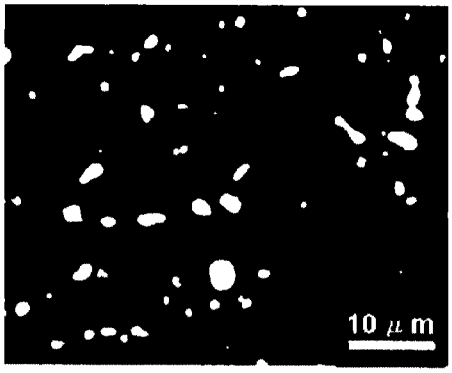
FIG. 15 is a TEM photograph of a cast ingot used in Examples of the invention when heat treatment is carried out at each temperature for 60 hours.
Figure 15:
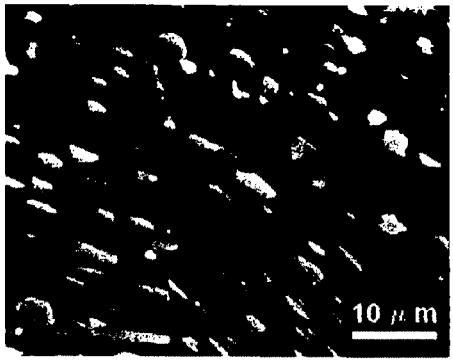
Figure 15:
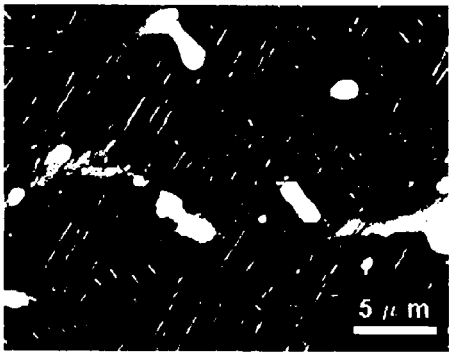
Figure 15:
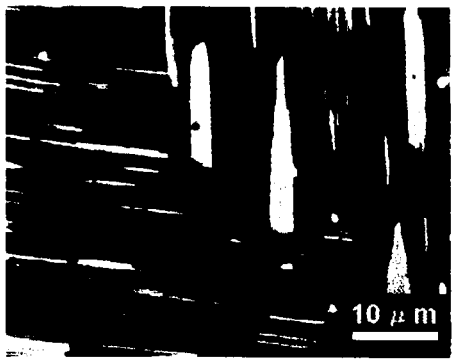
Figure 15:
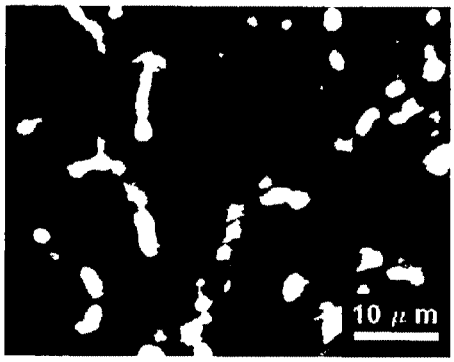
Figure 16:
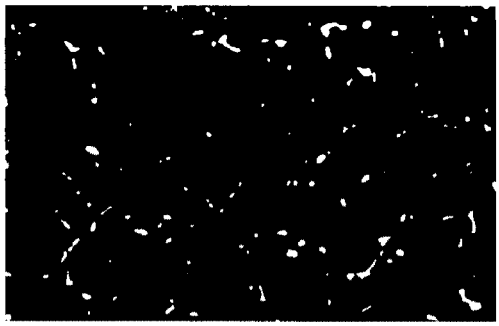
FIG. 16 is a TEM photograph showing the state of the conventional metal structure in Examples of the invention.
Figure 16:
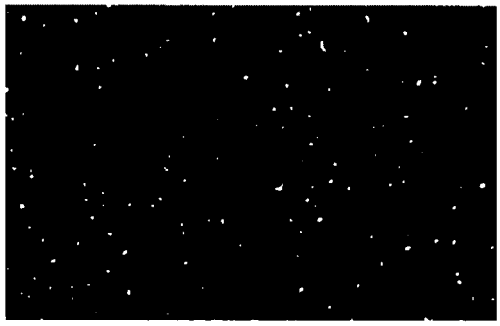
Figure 16:
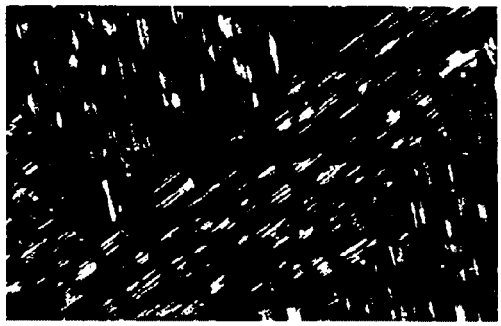
Figure 16:
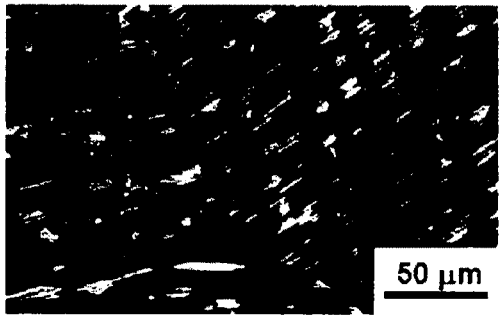

Next, the invention will be described with reference to Examples. Examples described herein are illustrative and are not intended that the invention be limited to the illustrated Examples. FIG. 13 is a graph showing the relation of heat treatment temperature and heat treatment time. FIG. 14 is a block graph showing the respective steps for evaluating the mechanical characteristics. FIG. 15 is a TEM photograph of a cast ingot when heat treatment is carried out at respective temperatures for 60 hours. FIG. 16 is a TEM photograph showing the state of a conventional metal structure in Examples.

As a magnesium alloy material, an Mg—Zn—Gd alloy containing 1 at. % of Zn, 2 at. % of Gd, and the rest including Mg and unavoidable impurities was loaded to a melting furnace and melted by flux refining. Successively, the heat melted material was cast (S1) by a die, as shown in FIG. 14, to produce an ingot of ϕ29 mm×L 60 mm and further the cast ingot was subjected to solution treatment (S2) at 520° C. for 2 hours and thereafter, the heat treatment was carried out at respective temperatures (S3) and those which were subjected to the plasticity processing (S4) at an extrusion temperature of 400° C. and an extrusion ratio of 10 and those which were not subjected to the plasticity processing (Examples) were produced and then a tensile test was carried out at room temperature. The strain velocity in the tensile test was $\epsilon=5.0\times10^{-4}$ ($s^{-1}$). The solution treatment and heat treatment were carried out in a muffle furnace and heat treatment was carried out at the respective temperatures for 2 hours, 4 hours, 10 hours, 20 hours, 40 hours, 60 hours, and 100 hours as shown in FIG. 13. In FIG. 14, the solution treatment and heat treatment were collectively described as heat treatment. As shown in FIG. 13, herein, 53 types in the total of the magnesium alloy material for testing in relation to the above-mentioned temperatures and periods were tested.

As shown in FIG. 15A, with respect to the state of the metal structure, as being solution treated, it was found that only the phase showing $Mg_3Gd$ appeared. As shown in FIG. 15(*b*), with respect to the state of the metal structure in the case of carrying out heat treatment at 250° C. for 60 hours, it was found that at least one of a β'-phase, a β1-phase and a β-phase, that is, a X-phase (lengthy precipitate 2) was precipitated and existed together with the phase showing $Mg_3Gd$. As shown in FIG. 15(*c*), with respect to the state of the metal structure in the case of carrying out heat treatment at 350° C. for 60 hours, it was found that the phase showing Mg Gd and the phase showing 14H-LPO (long period ordered structure) were precipitated. As shown in FIG. 15(*d*), with respect to the state of the metal structure in the case of carrying out heat treatment at 450° C. for 60 hours, it was found that the phase showing 14H-LPO was precipitated. Further, as shown in FIG. 15(*e*), with respect to the state of the metal structure in the case of carrying out heat treatment at 500° C. for 60 hours, it was found that the phase showing 14H-LPO was precipitated and existed together with the phase showing $Mg_3Zn_3Gd$.

As shown in FIG. 16, with respect to the magnesium alloy materials subjected to no heat treatment at 500° C. (as being subjected to solution treatment) and to heat treatment at 500° C. for 2 hours, 10 hours, and 60 hours, it was found that the phase of 14H-LPO and the phase of $Mg_3Gd$ existed alone in the metal structure, or that phase of 14H-LPO and the phase of $Mg_3Gd$ existed together; however precipitation of a β'-phase, a β1-phase and a β-phase, that is, an X-phase (lengthy precipitate 2) was not confirmed.

Further, Table 1 shows typical materials shown as Examples 1 to 5 in FIG. 13 and similarly typical materials as Comparative Examples 1 and 2 in FIG. 13 together with the conditions of the respective steps and Table 2 shows the configurations of the structures of Examples and Comparative Examples together with 0.2% proof strength and degree of elongation.

TABLE 1

| Name | Step | | | | | | | |
|---|---|---|---|---|---|---|---|---|
| Example 1 | A | Casting | → | Solubilization (520° C. × 2 hr) | → | Heat treatment (300° C. × 10 hr) | | |
| Example 2 | A | Casting | → | Solubilization (520° C. × 2 hr) | → | Heat treatment (300° C. × 10 hr) | → | Extrusion |
| Comparative Example 1 | A | Casting | → | Solubilization (520° C. × 2 hr) | → | Heat treatment (500° C. × 10 hr) | | |
| Comparative Example 2 | A | Casting | → | Solubilization (520° C. × 2 hr) | → | Heat treatment (500° C. × 10 hr) | → | Extrusion |

TABLE 2

| | Configuration of structure (precipitate) | 0.2% proof strength (MPa) | Degree of elongation (%) |
|---|---|---|---|
| Example 1 | $Mg_3Gd$ + X | 180 | 1.8 |
| Example 2 | $Mg_3Gd$ + X | 430 | 6.7 |
| Comparative Example 1 | Long period ordered structure alone | 170 | 3.9 |
| Comparative Example 2 | Long period ordered structure alone | 350 | 8.0 |

The magnesium alloy materials of Examples 1 to 5 all contained $Mg_3Gd$ and an X-phase in the metal structures and thus had high 0.2% proof strength and elongation (see FIG. 11).

On the other hand, it was understood that the magnesium alloy materials of Comparative Example 1 and Comparative Example 2 contained only the long period ordered structure and thus had lowered 0.2% proof strength as compared with those contained the precipitated X-phase (see FIG. 11).

As a result, it was found that even at a low temperature, one of a β'-phase, a β1-phase and a β-phase could be precipitated in a wide range by carrying out the heat treatment in the condition 1 of the heat treatment temperature and the heat treatment time show in FIG. 8. In Table 2, the X-phase is one of a β'-phase, a β1-phase and a β-phase in Examples 1 and 2. Additionally, in FIG. 8, the β-phase appeared in the region defined by the rectangular outer lines and the dashed-dotted line, the β1-phase appeared in the region defined by the dashed-dotted line and the dotted line, and the β'-phase appeared in the region defined by the dotted line and rectangular outer lines. Since it was understood that existence of one of the β'-phase, the β1-phase and the β-phase improved the mechanical characteristics under the condition 2 after extrusion, the mechanical characteristics after extrusion could be improved even under the condition 1 similarly to the condition 2 (see FIG. 11).

As described, a magnesium alloy material can be made usable as a material excellent in the mechanical characteristics by precipitating an X-phase (needle-like precipitate or board-like precipitate=lengthy precipitate=one of β'-phase, β1-phase and β-phase) even if it is an Mg—Zn—RE alloy. Additionally, even if same heat treatment, a β'-phase, a β1-phase and a β-phase show structural configurations for every portion different in accordance with the size of a product and the crystal grain diameter at the time of casting and these phases may sometimes exist alone or while being mixed.

The invention claimed is:

1. A method for manufacturing a magnesium alloy material, which comprises:

forming a cast material by casting an Mg—Zn—RE alloy consisting essentially of 0.5 to 3 at. % of Zn as an essential component, 1 to 5 at. % of a total amount of an RE selected from the group consisting of Gd, Tb, Tm and mixtures thereof as RE, and the rest including Mg and unavoidable impurities;

solubilizing the cast material; and heat treating the solubilized cast material under conditions satisfying $-18[\ln(x)]+240<y<-12[\ln(x)]+375$ and $2<x<300$, wherein y denotes the heat treatment temperature (° C.) and x denotes the heat treatment time (hr), to form a lengthy precipitate having a length of 0.1 to 20 μm and at least one phase state selected from the group consisting of a β-phase, a β'-phase, and a β1-phase.

2. A method for manufacturing a magnesium alloy material, which comprises:

forming a cast material by casting an Mg—Zn—RE alloy consisting essentially of 0.5 to 3 at. % of Zn as an essential component, 1 to 5 at. % of a total amount of an RE selected from the group consisting of Gd, Tb, Tm and mixtures thereof as RE, and the rest including Mg and unavoidable impurities;

solubilizing the cast material; and heat treating the solubilized cast material; and plastic processing the heat-treated cast material, wherein the heat treating is carried out under conditions satisfying $-18[\ln(x)]+240<y<-12[\ln(x)]+375$ and $2<x<300$, wherein y denotes the heat treatment temperature (° C.) and x denotes the heat treatment time (hr), to form a lengthy precipitate having a length of 0.1 to 20 μm and at least one phase state selected from the group consisting of a β-phase, a β'-phase, and a β1-phase.

3. A method for manufacturing a magnesium alloy material, which comprises:

forming a cast material by casting an Mg—Zn—RE alloy consisting essentially of 0.5 to 3 at. % of Zn as an essential component, 1 to 5 at. % of a total amount of an RE selected from the group consisting of Gd, Tb, Tm and mixtures thereof as RE, and the rest including Mg and unavoidable impurities;

solubilizing the cast material; and heat treating the solubilized cast material under conditions satisfying $330-20\times\ln(t)<T<325$ and $t\geqq5$, wherein T denotes the heat treatment temperature (° C.) and t denotes the heat treatment time (hr), to form a lengthy precipitate having a length of 0.1 to 20 μm and at least one phase state selected from the group consisting of a β-phase, a β'-phase, and a β1-phase.

4. A method for manufacturing a magnesium alloy material, which comprises:

forming a cast material by casting an Mg—Zn—RE alloy consisting essentially of 0.5 to 3 at. % of Zn as an essential component, 1 to 5 at. % of a total amount of an RE selected from the group consisting of Gd, Tb, Tm and mixtures thereof as RE, and the rest including Mg and unavoidable impurities;

solubilizing the cast material; and heat treating the solubilized cast material; and plastic processing the heat-treated cast material, wherein the heat treating is carried out under conditions satisfying $330-20\times\ln(t)<T<325$ and $t\geqq5$, wherein T denotes the heat treatment temperature (° C.) and t denotes the heat treatment time (hr), to form a lengthy precipitate having a length of 0.1 to 20 μm and at least one phase state selected from the group consisting of a β-phase, a β'-phase, and a β1-phase.

5. The method for manufacturing the magnesium alloy material according to claim 2, wherein plastic processing the heat-treated cast material is extrusion processing or forging processing.

6. The method for manufacturing the magnesium alloy material according to claim 4, wherein plastic processing the heat-treated cast material is extrusion processing or forging processing.

7. The method for manufacturing a magnesium alloy material according to claim 1, which comprises heat treating the solubilized cast material under conditions satisfying $-18[\ln(x)]+240<y<-12[\ln(x)]+375$ and $2<x<300$ to form a lengthy precipitate having a length of 0.1 to 20 μm and at least one phase state selected from the group consisting of a β-phase, a β'-phase, and a β1-phase of $Mg_5Gd$, $Mg_7Gd$, or $Mg_5Gd$ in combination with $Mg_7Gd$, wherein y denotes the heat treatment temperature (° C.) and x denotes the heat treatment time (hr).

8. The method for manufacturing a magnesium alloy material according to claim 2, which comprises heat treating the solubilized cast material under conditions satisfying $-18[\ln(x)]+240<y<-12[\ln(x)]+375$ and $2<x<300$ to form a lengthy precipitate having a length of 0.1 to 20 μm and at least one phase state selected from the group consisting of a β-phase, a β'-phase, and a β1-phase of $Mg_5Gd$, $Mg_7Gd$, or $Mg_5Gd$ in combination with $Mg_7Gd$, wherein y denotes the heat treatment temperature (° C.) and x denotes the heat treatment time (hr).

9. The method for manufacturing a magnesium alloy material according to claim 3, which comprises heat treating the solubilized cast material under conditions satisfying $330-20\times\ln(t)<T<325$ and $t\geqq5$, to form a lengthy precipitate having a length of 0.1 to 20 μm and at least one phase state selected from the group consisting of a β-phase, a β'-phase, and a β1-phase of $Mg_5Gd$, $Mg_7Gd$, or $Mg_5Gd$ in combination with $Mg_7Gd$, wherein T denotes the heat treatment temperature (° C.) and t denotes the heat treatment time (hr).

10. The method for manufacturing a magnesium alloy material according to claim 4, which comprises heat treating the solubilized cast material under conditions satisfying $330-20\times\ln(t)<T<325$ and $t\geqq5$, to form a lengthy precipitate having a length of 0.1 to 20 μm and at least one phase state selected from the group consisting of a β-phase, β'-phase, and a β1-phase of $Mg_5Gd$, $Mg_7Gd$, or $Mg_5Gd$ in combination with $Mg_7Gd$, wherein T denotes the heat treatment temperature (° C.) and t denotes the heat treatment time (hr).

11. The method for manufacturing a magnesium alloy material according to claim 1, which comprises forming a cast material by casting an Mg—Zn—RE alloy consisting of 0.5 to 3 at. % of Zn as an essential component, 1 to 5 at. % of a total amount of an RE selected from the group consisting of Gd, Tb, Tm and mixtures thereof as RE, and 0.1 to 0.5 at. % of Zr, with the rest including Mg and unavoidable impurities.

12. The method for manufacturing a magnesium alloy material according to claim 2, which comprises forming a cast material by casting an Mg—Zn—RE alloy consisting of 0.5 to 3 at. % of Zn as an essential component, 1 to 5 at. % of a total amount of an RE selected from the group consisting of Gd, Tb, Tm and mixtures thereof as RE, and 0.1 to 0.5 at. % of Zr, with the rest including Mg and unavoidable impurities.

13. The method for manufacturing a magnesium alloy material according to claim 3, which comprises forming a cast material by casting an Mg—Zn—RE alloy consisting of 0.5 to 3 at. % of Zn as an essential component, 1 to 5 at. % of a total amount of an RE selected from the group consisting of Gd, Tb, Tm and mixtures thereof as RE, and 0.1 to 0.5 at. % of Zr, with the rest including Mg and unavoidable impurities.

14. The method for manufacturing a magnesium alloy material according to claim 4, which comprises forming a cast material by casting an Mg—Zn—RE alloy consisting of 0.5 to 3 at. % of Zn as an essential component, 1 to 5 at. % of a total amount of RE selected from the group consisting of Gd, Tb, Tm and mixtures thereof as RE, and 0.1 to 0.5 at. % of Zr, with the rest including Mg and unavoidable impurities.

15. The method for manufacturing a magnesium alloy material according to claim 1, which comprises forming a cast material by casting an Mg—Zn—RE alloy consisting of 0.5 to 3 at. % of Zn as an essential component, and 1 to 5 at. % of a total amount of an RE selected from the group consisting of Gd, Tb, Tm and mixtures thereof as RE, with the rest including Mg and unavoidable impurities.

16. The method for manufacturing a magnesium alloy material according to claim 2, which comprises forming a cast material by casting an Mg—Zn—RE alloy consisting of 0.5 to 3 at. % of Zn as an essential component, and 1 to 5 at. % of a total amount of an RE selected from the group consisting of Gd, Tb, Tm and mixtures thereof as RE, with the rest including Mg and unavoidable impurities.

17. The method for manufacturing a magnesium alloy material according to claim 3, which comprises forming a cast material by casting an Mg—Zn—RE alloy consisting of 0.5 to 3 at. % of Zn as an essential component, and 1 to 5 at. % of a total amount of an RE selected from the group consisting of Gd, Tb, Tm and mixtures thereof as RE, with the rest including Mg and unavoidable impurities.

18. The method for manufacturing a magnesium alloy material according to claim 4, which comprises forming a cast material by casting an Mg—Zn—RE alloy consisting of 0.5 to 3 at. % of Zn as an essential component, and 1 to 5 at. % of a total amount of an RE selected from the group consisting of Gd, Tb, Tm and mixtures thereof as RE, with the rest including Mg and unavoidable impurities.

* * * * *